US005599014A

United States Patent [19]

Kitahara et al.

[11] Patent Number: 5,599,014

[45] Date of Patent: Feb. 4, 1997

[54] SHEET CONVEY APPARATUS

[75] Inventors: Yoshihiko Kitahara, Ushiku; Yuji Takahashi, Tokyo; Hitoshi Fujimoto, Kawasaki, all of Japan

[73] Assignee: Canon Kabushiki Kaisha, Tokyo, Japan

[21] Appl. No.: 527,384

[22] Filed: Sep. 13, 1995

Related U.S. Application Data

[63] Continuation of Ser. No. 120,915, Sep. 15, 1993, abandoned.

[30] Foreign Application Priority Data

Sep. 17, 1992 [JP] Japan ..... 4-248002

[51] Int. Cl.[6] ..... B65H 5/16

[52] U.S. Cl. ..... 271/270; 271/263

[56] References Cited

U.S. PATENT DOCUMENTS

| | | | |
|---|---|---|---|
| 4,030,607 | 6/1977 | Suda et al. | 271/263 X |
| 4,229,650 | 10/1980 | Takahashi et al. | 250/223 R |
| 4,390,175 | 6/1983 | Takahashi | 271/157 |
| 4,729,556 | 3/1988 | Fujii et al. | 271/263 |
| 5,011,128 | 4/1991 | Tsujii | 271/265 X |
| 5,029,837 | 7/1991 | Uchiyama | 271/263 X |
| 5,181,705 | 1/1993 | Ueda et al. | 271/3 |

FOREIGN PATENT DOCUMENTS

| | | | |
|---|---|---|---|
| 2226048 | 2/1973 | Germany | 271/263 |
| 0022234 | 2/1983 | Japan | 271/263 |
| 0003833 | 1/1991 | Japan | 271/265 |
| 3205233 | 9/1991 | Japan | 271/265 |

*Primary Examiner*—William E. Terrell
*Assistant Examiner*—T. Kelly
*Attorney, Agent, or Firm*—Fitzpatrick, Cella, Harper & Scinto

[57] ABSTRACT

The present invention provides a sheet convey apparatus having a conveyor for conveying a sheet, a guide device for guiding the sheet conveyed by the conveyor along a passage, a detector for detecting thickness of the sheet conveyed by the conveyor, and a control for controlling a conveying speed of the conveyor in accordance with the thickness of the sheet detected by the detector.

38 Claims, 14 Drawing Sheets

SHEET CONVEY APPARATUS

This application is a continuation, of application Ser. No. 08/120,915, filed Sep. 15,1993, now abandoned.

BACKGROUND OF THE INVENTION

1. Field of the Invention

The present invention relates to a sheet convey apparatus having a convey means for conveying a sheet and a guide means for regulating a zone through which the sheet to be conveyed passes.

2. Related Background Art

A conventional automatic original feeding apparatus of circulating type is constituted as shown in FIG. 18.

Such automatic original feeding apparatus of circulating type 101 serves to automatically send an original onto a platen glass 103 of a copying machine 102. A sheet discharge auxiliary platform 104 serves to transport the original from the platen glass 103 to the circulating automatic original feeding apparatus 101 without catching a leading end (in a discharge direction) of the original when the original set on the platen glass 103 is discharged. An original tray 111 serves to stack the originals to be copied thereon, and the originals after copied are discharged on this original tray. A recycle lever 112 is rested on the original stack by a recycle motor (not shown) and serves to detect one cycle of the circulation of originals in such a manner that, when a trailing end of the last original passes through the recycle lever, it is detected by a recycle sensor 169. An original detection sensor 113 comprising an optical sensor of permeable type serves to detect the fact that the originals are set on the original tray 111. A shutter 115 is normally protruded into an original conveying path as shown; but, when the sheet (original) is supplied, the shutter is retracted from the original conveying path by a shutter solenoid (not shown) to open or clear such path. A semi-circular roller 114 has a cut-out portion and is normally retracted below the conveying path; but, as the semi-circular roller 114 is rotated, the original is fed downstreamly by a cylindrical portion of the semi-circular roller. A sheet feed roller 117 serves to feed the original further downstreamly.

A separation belt 116 is urged against the sheet feed roller 117 and is rotated in a direction opposite to an original feeding direction. A drive roller 119 is abutted against a regist roller 118 and is driven by a drive motor (not shown) to pinch the original between the rollers 118, 119 and convey the original. A regist post sensor 125 comprising a sensor of permeable type serves to detect the presence/absence of the original. A convey belt 107 is wound around a belt drive roller 105 and a driven roller 106 and is tensioned between these rollers 105, 106. Further, the convey belt is closely contacted with the platen glass 103 by belt urging rollers 108, 109 and 110. When the convey belt 107 is rotated by the driving force from the drive roller 105, the original is shifted while closely contacting with the platen glass 103. The belt drive roller 105 is reversible so that when it is rotated normally the original is supplied and when it is rotated reversely the original is discharged.

A first drive roller 120 and a second drive roller 121 are urged against the drive roller 119 and serve to pinch and convey the original, respectively. A flapper 124 is driven by a flapper solenoid (not shown) to switch the original conveying path so that it assumes a position shown by the solid line in an original discharge condition and assumes a position shown by the broken line in an original reverse (inversion) condition. A discharge roller 122 and an auxiliary discharge roller 123 cooperate with each other to discharge the original onto the tray 111.

However, in the above-mentioned conventional automatic original feeding apparatus, if any sheet is conveyed at a high speed in order to increase the treatment speed, the following problems will arise.

That is to say, if a thick sheet passes through a conveying path portion having a small radius of curvature, immediately after the sheet leaves the roller, a trailing end of the sheet will beat or rub the guide plate, thereby generating the great noise. Although the noise level may be suppressed below a limit value described in the specification of the apparatus when a thin sheet is used, if the thick sheet is used, the noise lever will sometimes exceed the limit value. Further, if the thin sheet is struck against the guide plate having the small radius of curvature and comprising a ribbed convex member, the leading end of the sheet will be torn.

SUMMARY OF THE INVENTION

An object of the present invention is to prevent the occurrence of the noise by reducing the conveying resistance when a thick sheet is conveyed, and to prevent a thin sheet from tearing when the thin sheet is conveyed.

In order to achieve the above object, according to the present invention, there is provided a sheet convey apparatus comprising convey means for conveying a sheet, guide means for guiding the sheet conveyed by the convey means along a passage, detection means for detecting a thickness of the sheet conveyed by the convey means, and control means for controlling a conveying speed of the convey means in accordance with the sheet thickness detected by the detection means.

DETAILED DESCRIPTION OF THE PREFERRED EMBODIMENTS

Figure 1:
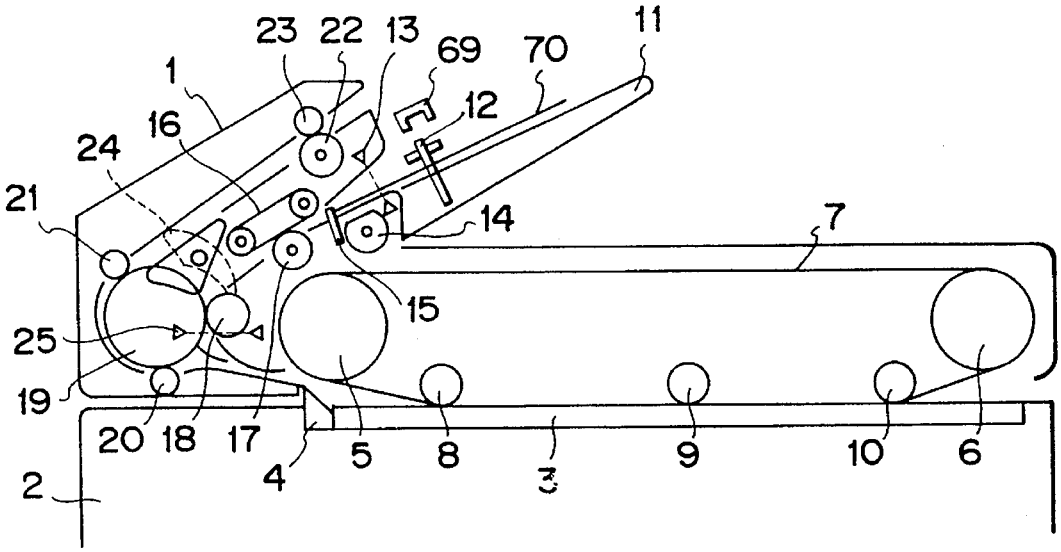
FIG. 1 is a longitudinal sectional view of an original feeding apparatus of circulating type, according to a first embodiment of the present invention.

FIG. 1 is a longitudinal sectional view of an original feeding apparatus of circulating type, according to a first embodiment of the present invention.

In FIG. 1, the automatic original feeding apparatus of circulating type 1 serves to automatically send an original 70 onto a platen glass 3 of a copying machine 2. A sheet discharge auxiliary platform 4 serves to transport the original from the platen glass 3 to the circulating automatic original feeding apparatus without catching a leading end (in a discharge direction) of the original 70 when the original 70 set on the platen glass 3 is discharged. An original tray 11 serves to stack the originals to be copied thereon, and the originals after copied are discharged on this original tray. A recycle lever 12 is rested on the original stack 70 by a recycle motor (not shown) and serves to detect the absence of the original 70 when a trailing end of the original passes through the recycle lever, it is detected by a recycle sensor 69.

An original detection sensor 13 comprising an optical sensor of permeable type serves to detect the fact that the originals 70 are set on the original tray. A shutter 15 is normally protruded into an original conveying path as shown. The shutter can be retracted from the original conveying path by a shutter solenoid (not shown) to open or clear such path. A semi-circular roller 14 has a cut-out portion and is normally retarded below the conveying path as shown; but, as the semi-circular roller 14 is rotated, the original 70 is fed downstreamly by a cylindrical portion of the semi-circular roller. A sheet feed roller 17 serves to feed the original 70 further downstreamly.

A separation belt 16 is urged against the sheet feed roller 17 and is rotated in a direction opposite to an original feeding direction, so that only a lowermost original in the original stack 70 is supplied from the sheet supply roller 17. A drive roller 19 is abutted against a regist roller 18 and is driven by a drive motor 63 to pinch the original between the rollers 18, 19 and convey the original 70. A regist post sensor 25 comprising a sensor of permeable type serves to detect the presence/absence of the original.

A convey belt 7 is wound around a belt drive roller 5 and a driven roller 6 and is tensioned between these rollers 5, 6. Further, the convey belt is closely contacted with the platen glass 3 by belt urging rollers 8, 9 and 10. When the convey belt 7 is rotated by the driving force from the drive roller 5, the original 70 is shifted while closely contacting with the platen glass 3. The belt drive roller 5 is reversible so that when it is rotated normally the original is supplied and when it is rotated reversely the original is discharged. A first drive roller 20 and a second drive roller 21 are urged against the drive roller 19 and serve to pinch and convey the original, respectively.

A flapper 24 is driven by a flapper solenoid (not shown) to switch the original conveying path so that it assumes a position shown by the solid line in an original discharge condition and assumes a position shown by the broken line in an original reverse (inversion) condition. A discharge roller 22 and an auxiliary discharge roller 23 cooperate with each other to discharge the original 70 onto the tray 11.

Figure 2:
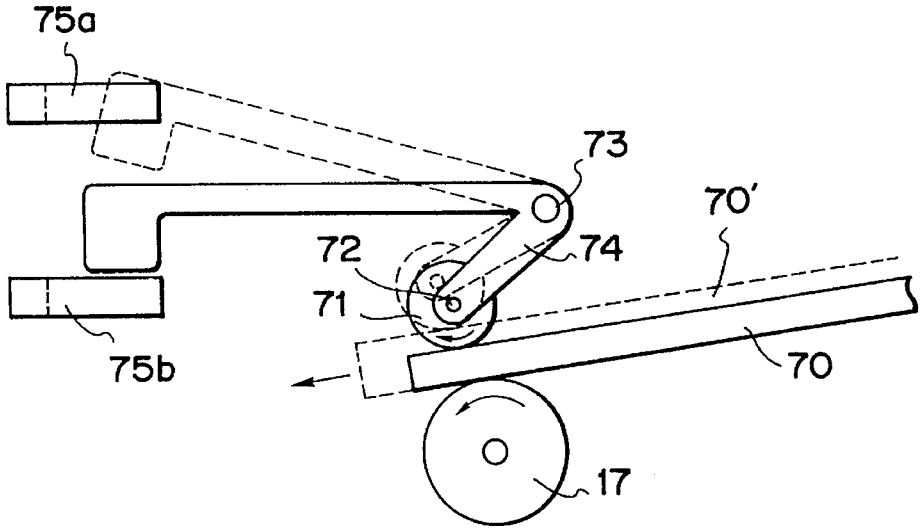
FIG. 2 is a side view of a sheet thickness detection sensor of the original feeding apparatus of circulating type of FIG. 1.

Next, the construction of the sheet thickness detection sensor of the sheet feeding apparatus will be fully explained with reference to FIG. 2.

A roller 71 is rotatably mounted on a roller shaft 72 arranged above and in a confronting relation to the sheet supply roller 17. The roller shaft 72 is supported by a sheet thickness detection lever 74 which is pivotable around a lever shaft 73. In association with the other end of the sheet thickness detection lever 74, there are disposed sheet thickness sensors **75*a*, 75*b*** each comprising an optical sensor of permeable type for detecting the position of the sheet thickness detection lever.

If the thickness of the sheet is greater than a certain value, the sheet thickness detection lever 74 assumes a position shown by the broken line, where the sheet thickness sensor **75*a* is turned ON, thereby detecting a thick sheet. On the other hand, if the sheet thickness is smaller than the certain value, the sheet thickness detection lever 74 assumes a position shown by the solid line, where the sheet thickness sensor 75*b*** is turned ON, thereby detecting a thin sheet.

Next, the construction of a drive system of the circulating automatic original feeding apparatus of FIG. 1 will be explained with reference to FIG. 3.

Figure 3:
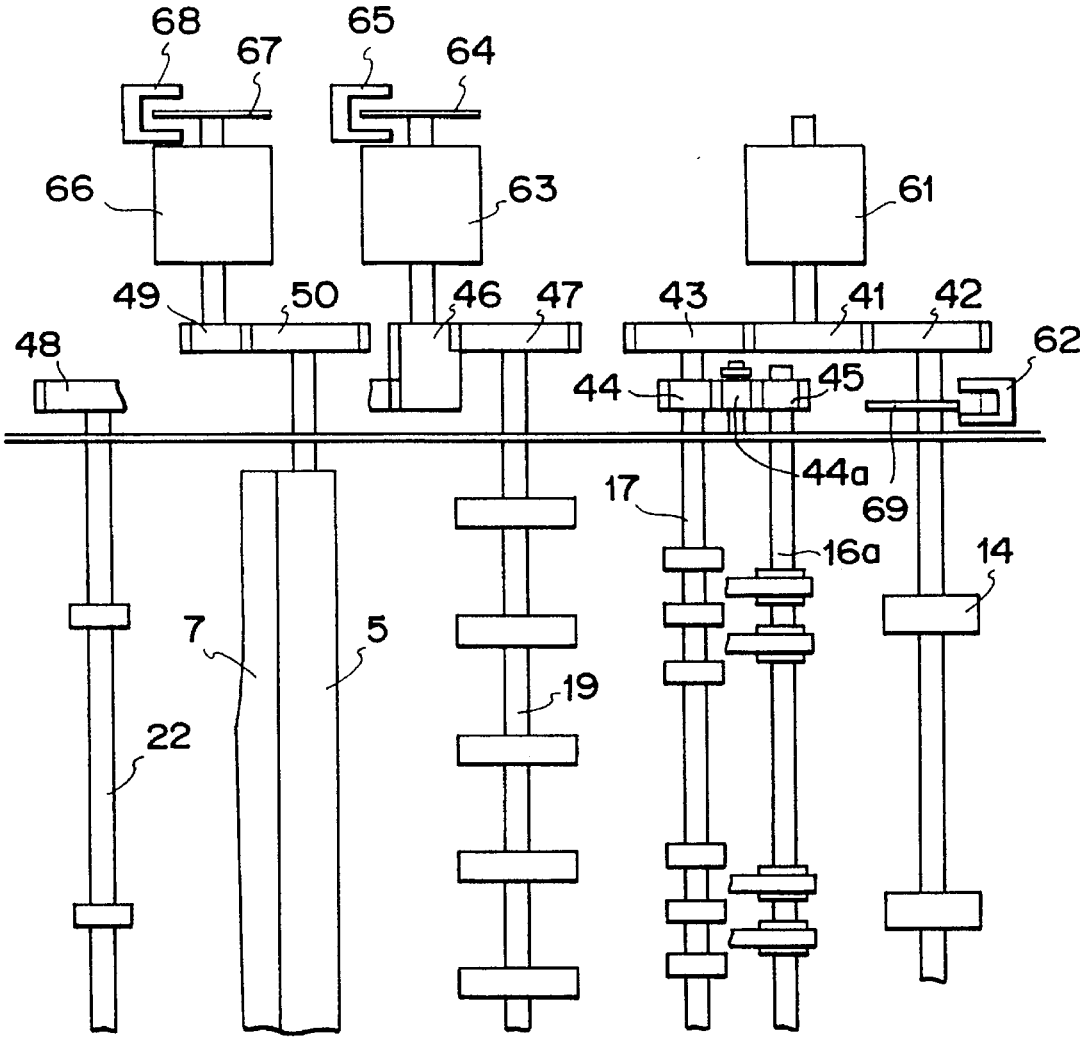
FIG. 3 is a development view of a drive system of the original feeding apparatus of circulating type of FIG. 1.

FIG. 3 is a development view showing the drive system of the automatic original feeding apparatus. In FIG. 3, a separation motor 61 has an output shaft to which a separation motor gear 41 is secured. A rotational force of the separation motor 61 is transmitted to a semi-circular roller gear 42 and a drive roller gear 43 via the separation motor gear 41, thereby rotating the semi-circular roller 14 and the sheet supply roller 17. Further, a gear 44 is secured to a roller shaft of the sheet supply roller 17. A rotational force from the gear 44 is transmitted to a gear 45 secured to a separation belt shaft **16*a* via an idler gear 44*a*, with the result that the separation belt 16 is rotated in a direction opposite to the sheet supply roller 17. A semi-circular flag 69 is secured to a roller shaft of the semi-circular roller 14, so that the cut-out portion of the semi-circular roller can be detected by a semi-circular sensor 62**.

The drive motor 63 has an output shaft to which a drive motor gear 46 is secured. A rotational force of the drive motor 63 is transmitted to a drive roller gear 47 via the drive motor gear 46 and is also transmitted to a sheet discharge roller gear 48 via an idler gear (not shown), thereby rotating the drive roller 19 and the discharge roller 22. A drive clock disk 64 having a plurality of slits formed in a periphery thereof at an equidistant interval is secured to a motor shaft of the drive motor 63 at an opposite side of the drive motor gear 46, and a drive clock sensor 65 comprising an optical sensor of permeable type for detecting the slit is arranged in the proximity of the drive clock disk 64.

A belt motor 66 has a motor shaft to which a belt motor gear 49 is secured. A rotational force of the belt motor 66 is transmitted to the belt drive roller 5 via the belt motor gear 49 and a belt drive gear 50, thereby rotating the convey belt 7. A belt clock disk 67 having a plurality of slits formed in a periphery thereof at an equidistant interval is secured to a motor shaft of the belt motor 66 at an opposite side of the belt motor gear 49, and a belt clock sensor 68 comprising an optical sensor of permeable type for detecting the slit is arranged in the proximity of the belt clock disk 67.

Next, a control circuit of the circulating automatic original feeding apparatus will be explained with reference to FIG. 4.

The control circuit mainly comprises a one-chip microcomputer (referred to as "MCOM" hereinafter) 80 including a ROM, RAM and the like. Signals from a recycle sensor 69 for detecting one circulation of the originals, original detection sensor 13 for detecting the presence/absence of the original, semi-circular sensor 62 for detecting the cut-out portion of the semi-circular roller 14, drive clock sensor 65 for counting the rotation amount of the drive motor 63 and the shifting amounts of the drive roller 19 and the discharge roller 22, belt clock sensor 68 for counting the rotation amount of the belt motor 66 and the shifting amount of the convey belt 7, regist post sensor 25 disposed immediately behind the drive roller 19 and adapted to the leading and trailing ends of the original 70, and sheet thickness sensors 75*a*, 75*b* for detecting whether the sheet thickness is greater than the predetermined value or not are inputted to input ports $P_0$ to $P_6$ of the MCOM 80, respectively.

Further, output signals regarding ON/OFF operation of the recycle motor (not shown) for rotating the recycle lever 12 to rest it on the original stack, ON/OFF operation of the separation motor 61 for controlling the rotations of the semi-circular roller 14, sheet supply roller 17 and separation belt 16, ON/OFF operation of the drive motor 63 for controlling the rotation of the drive roller 19, ON/OFF operation of the belt motor 66 for controlling the shifting amount of the convey belt 7, ON/OFF operation of the shutter solenoid for opening the sheet supply opening, and ON/OFF operation of the flapper solenoid for switching the sheet conveying path between the original reverse condition and the original discharge condition are outputted from output ports $F_0$ to $F_5$ of the MCOM to drivers $D_0$ to $D_5$, respectively.

Next, in the circulating automatic sheet feeding apparatus of FIG. 1, a controlling method regarding a copying operation when two originals are set will be explained, for example, with reference to FIGS. 5 to 7.

Figure 5:
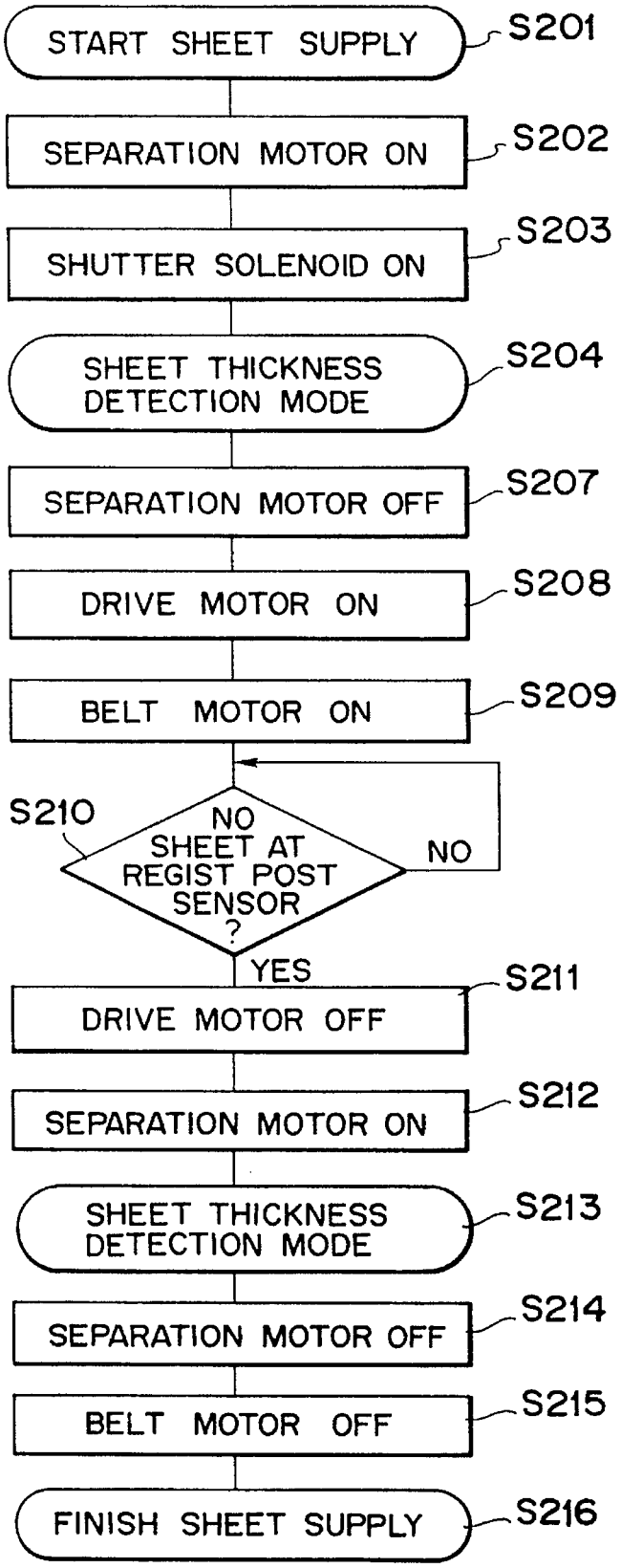
FIG. 5 is a control flow chart of the original feeding apparatus of circulating type of FIG. 1, regarding the sheet supply.
Figure 6:
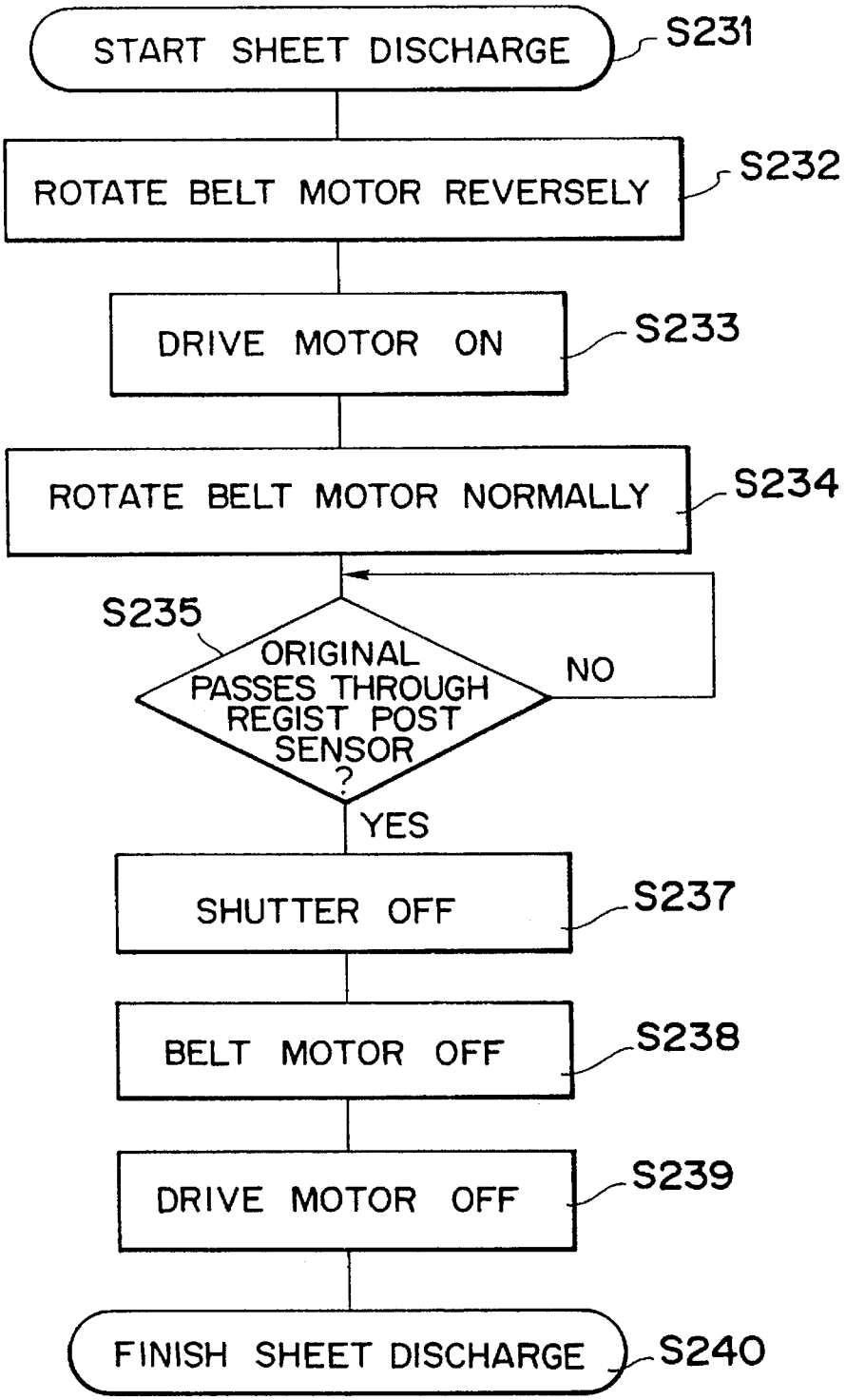
FIG. 6 is a control flow chart of the original feeding apparatus of circulating type of FIG. 1, regarding the sheet discharge.
Figure 7:
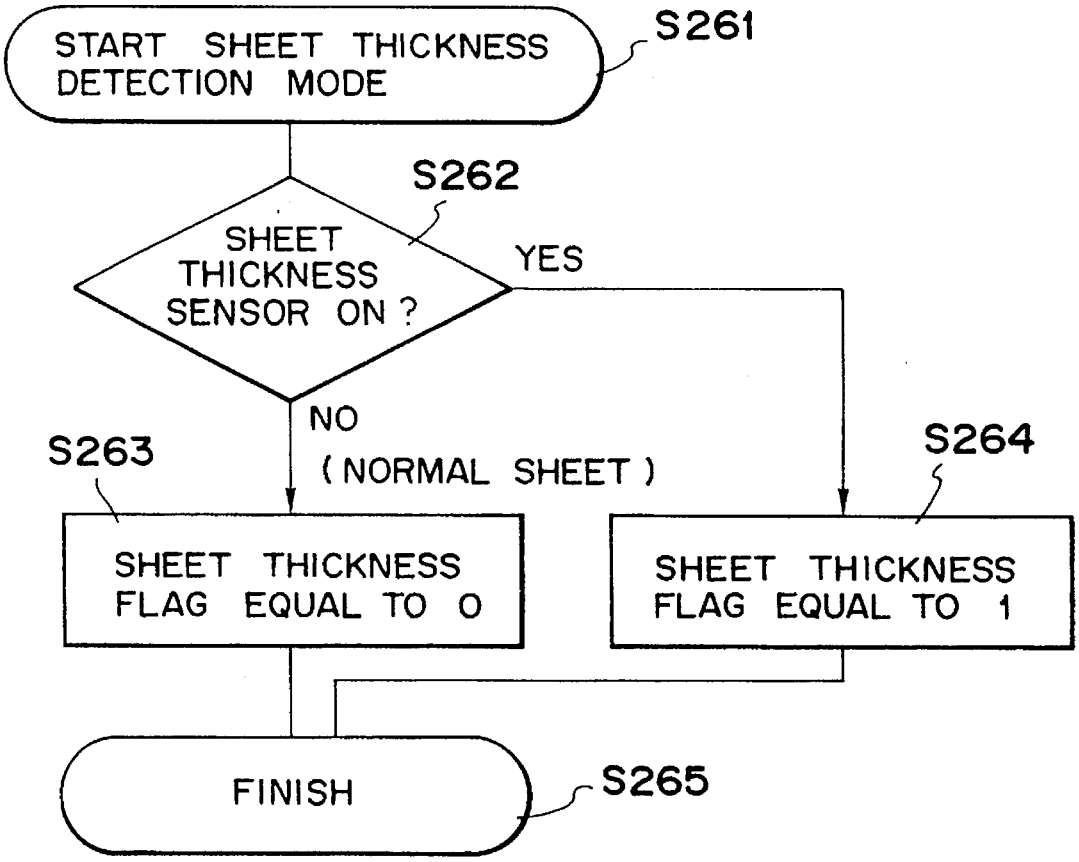
FIG. 7 is a control flow chart of the original feeding apparatus of circulating type of FIG. 1, regarding a sheet thickness detection mode.
Figure 8:
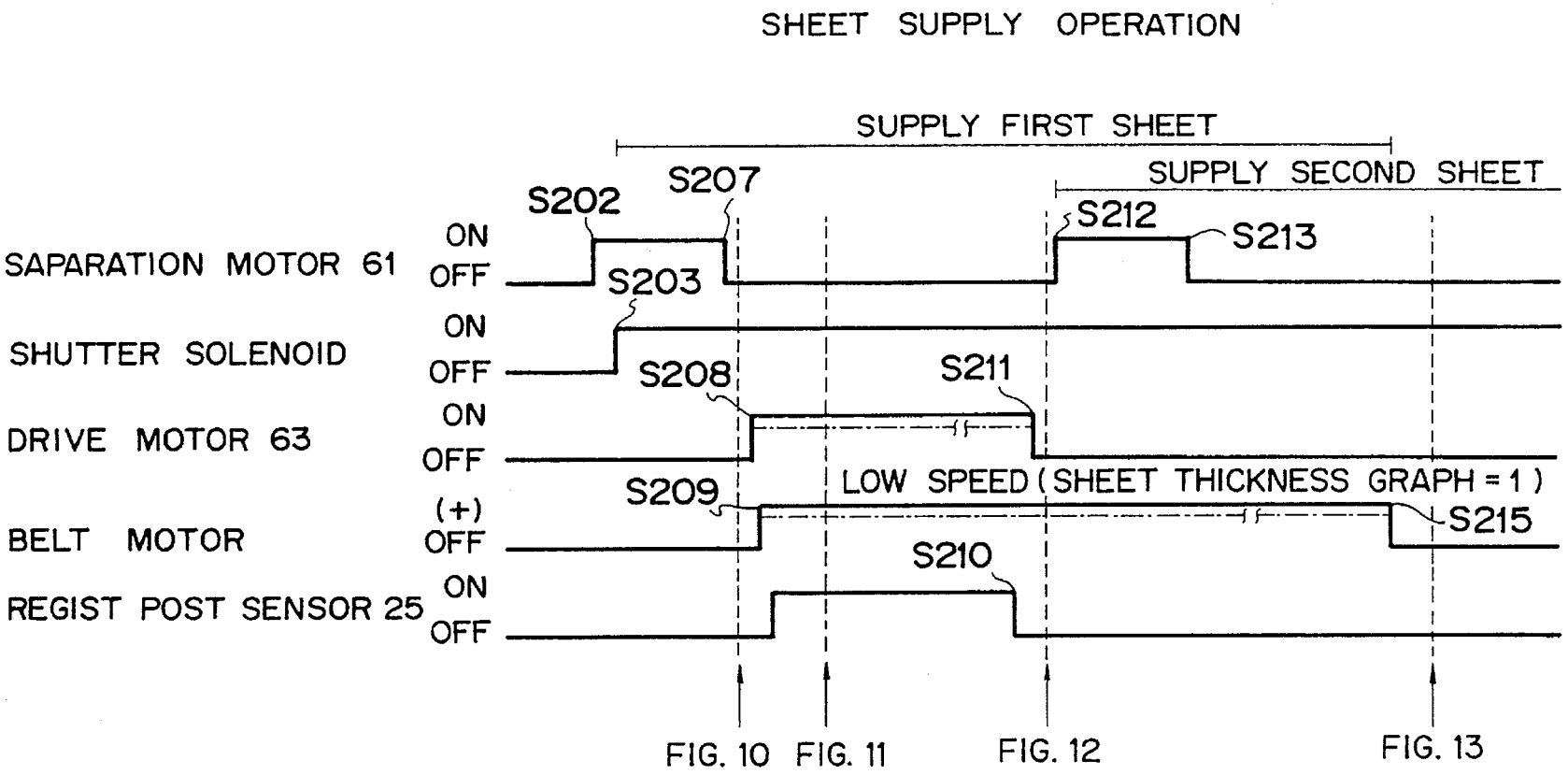
FIG. 8 is a timing chart regarding the sheet supply in the original feeding apparatus of circulating type of FIG. 1.
Figure 9:
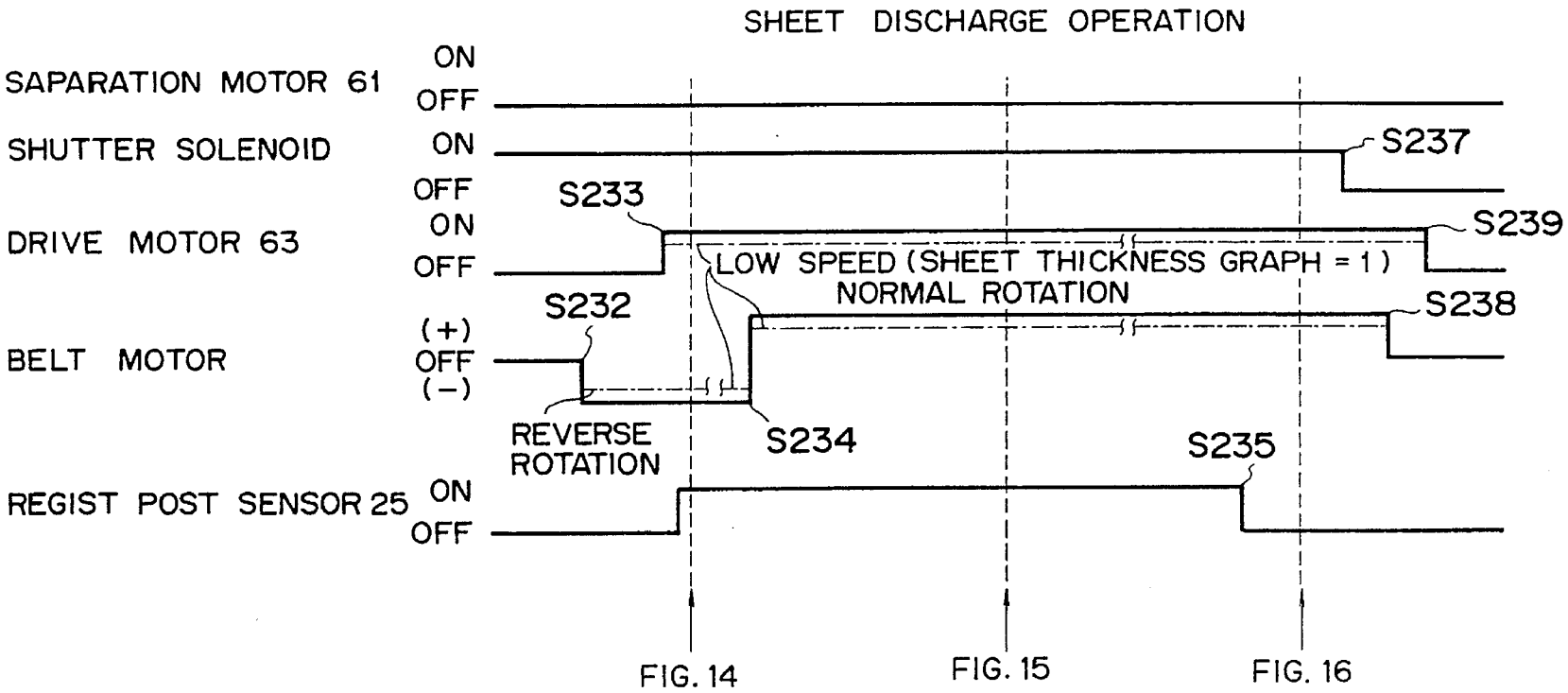
FIG. 9 is a timing chart regarding the sheet discharge in the original feeding apparatus of circulating type of FIG. 1.

FIGS. 5 to 7 show control flow charts, FIGS. 8 and 9 show control signals of the separation motor 61, shutter solenoid (not shown), drive motor 63, belt motor 66 and regist post sensor 25 when they are operated in accordance with the control flow charts of FIGS. 5 to 7, and FIGS. 10 and 16 show a condition of the original when the apparatus is operated in accordance with the control flow charts of FIGS. 5 to 7.

When the originals 70*a*, 70*b* are detected by the original detection sensor 13, as a start signal is sent from the image forming apparatus, the sheet supply operation of the circulating automatic original feeding apparatus is started (step S201). The separation motor 61 is turned ON (step S202), and the originals 70*a*, 70*b* are abutted against the shutter 15 by the rotation of the semi-circular roller 14. When the shutter solenoid (not shown) is turned 0N (step S203), the shutter 15 is retracted from the conveying path, thereby opening it. The original 70*a* is conveyed downstreamly by the rotation of the semi-circular roller 14. Now, the separation belt 16 is rotated in the direction opposite to the sheet supply roller 17. Since the friction force between the originals 70*a* and 70*b* is smaller than the returning friction force between the original 70*a* and the separation belt 16, the original 70*a* is not supplied.

Figure 10:
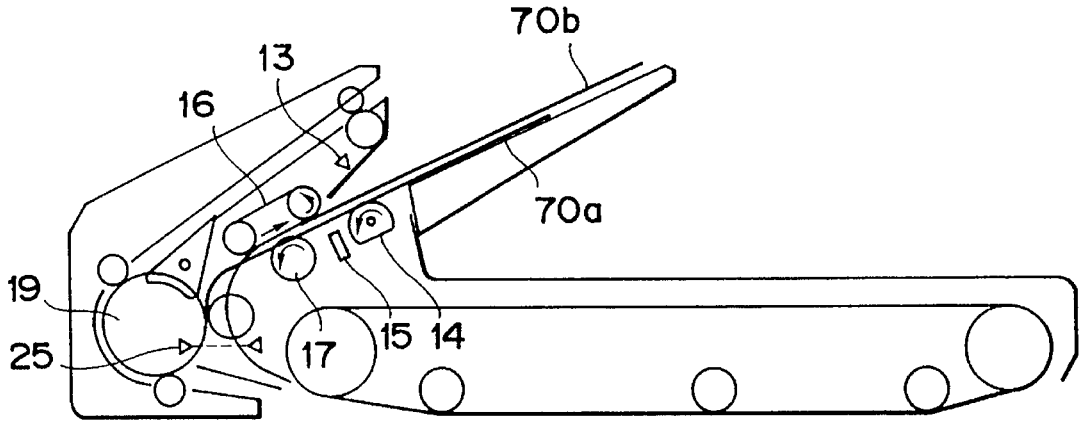
FIGS. 10 to 16 are views for explaining an operation of the original feeding apparatus of circulating type of FIG. 1.
Figure 11:
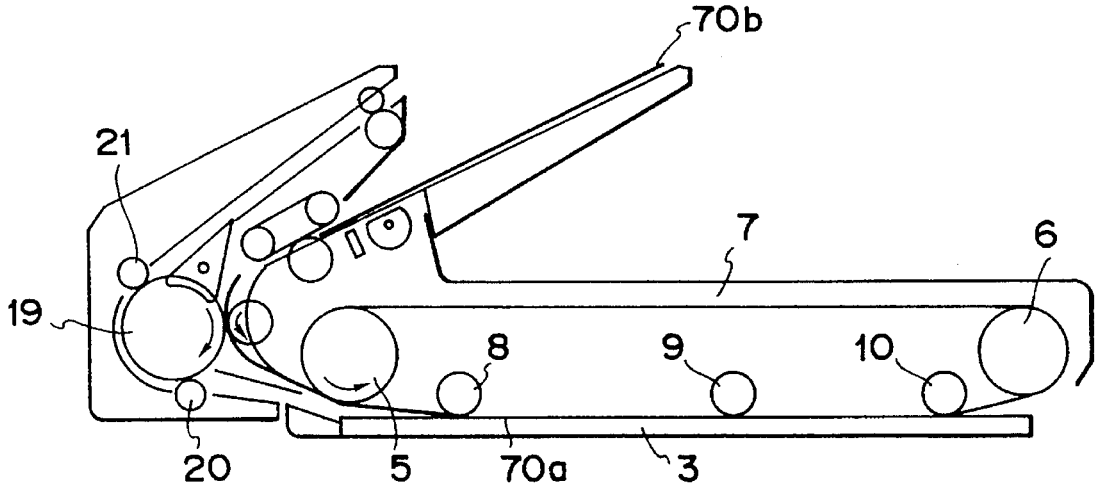
Figure 12:
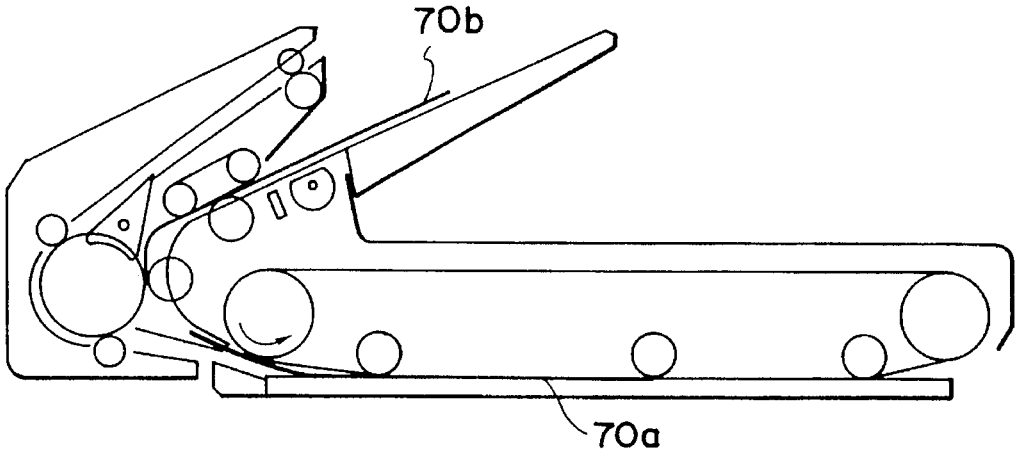

Then, the signal from the sheet thickness sensor (FIG. 2) disposed above the sheet supply roller 17 is checked (step S204). If the original is the normal sheet, the following control is effected. That is, when the separation motor is further rotated, since the trailing end of the original 70*a* is pushed even after the leading end of the original is abutted against the nip between the drive roller 19 and the regist roller 18, a loop is formed in the original 70*a*. The clock of the separation motor 61 is counted to form a predetermined amount of loop, and then the separation motor is stopped (step S207). In this point, a condition shown in FIG. 10 is established.

Figure 13:
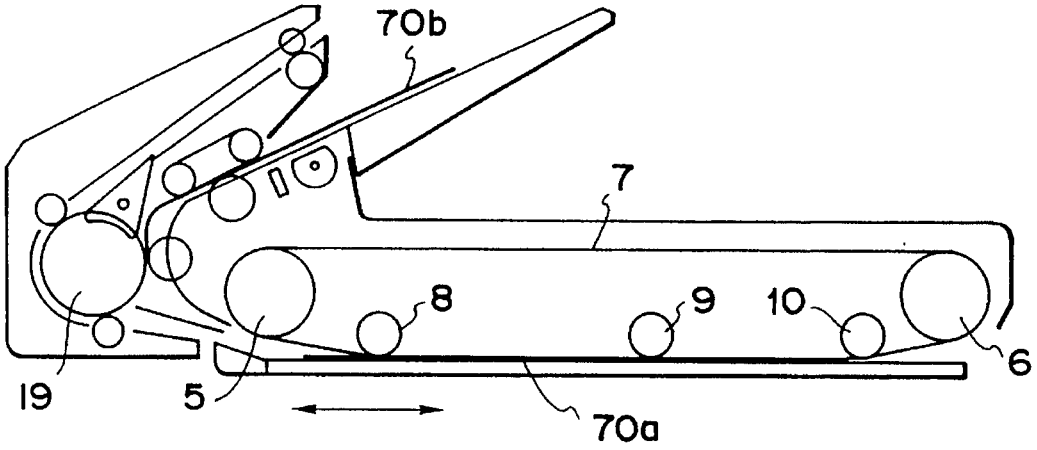

Subsequently, when the drive motor 63 is turned ON (step S208), the original 70*a* is conveyed. The belt motor 66 is turned ON before the leading end of the original 70*a* reaches the convey belt 7 (step S209), with the result that the original 70*a* is conveyed along and on the platen glass 3 by the convey belt 7 urged against the platen glass by the urging rollers 8, 9 and 10. When the original 70*a* leaves the regist post sensor 25, the drive motor 63 is turned OFF, thereby stopping the drive roller 19 (step S211). The separation motor 61 is turned ON (step S212) to convey the second original 70*b* until the second original is abutted against the nip between the drive roller 19 and the regist roller 18; meanwhile, the thickness of the second original is detected by the detection mode (step S213). Then, an appropriate loop is formed in the second original in a manner similar to the first original, and then the separation motor 61 is turned OFF (step S214), thereby stopping the second original. Then, the first original 70*a* is further conveyed until the trailing end of the first original passing through the regist post sensor 25 reaches a predetermined position on the platen glass 3, and the belt motor is stopped (step S215). In this way, the original supply is finished (condition shown in FIG. 13).

Thereafter, the copying operation is effected by the copying machine 2.

Then, the discharge of the first original 70*a* and the supply of the second original 70*b* are effected (FIG. 6).

Figure 14:
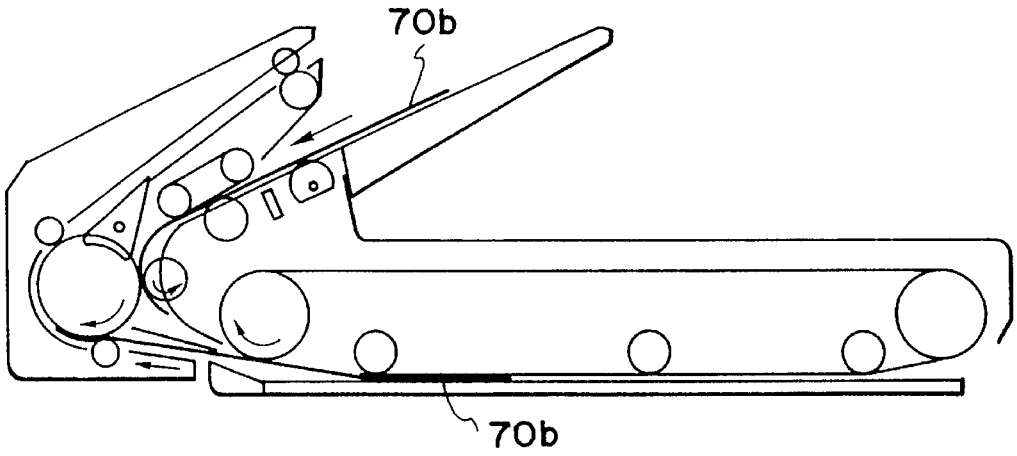
Figure 15:
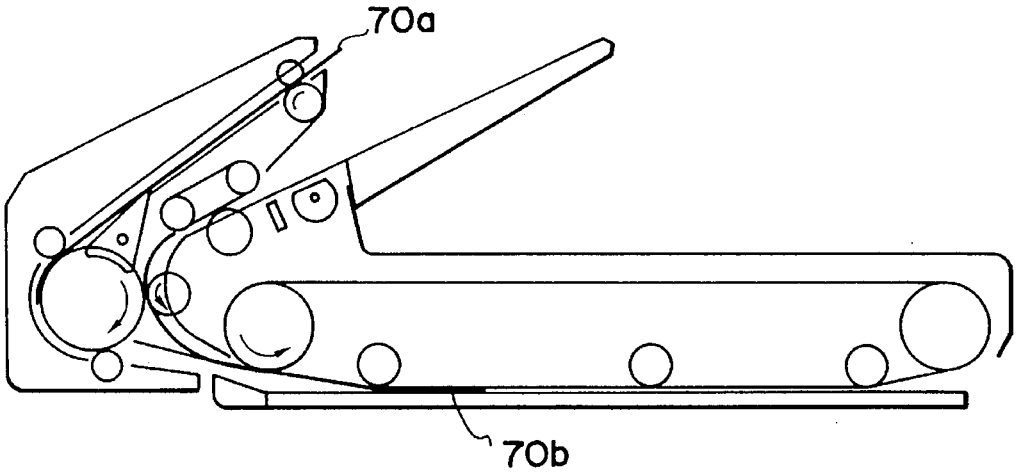
Figure 16:
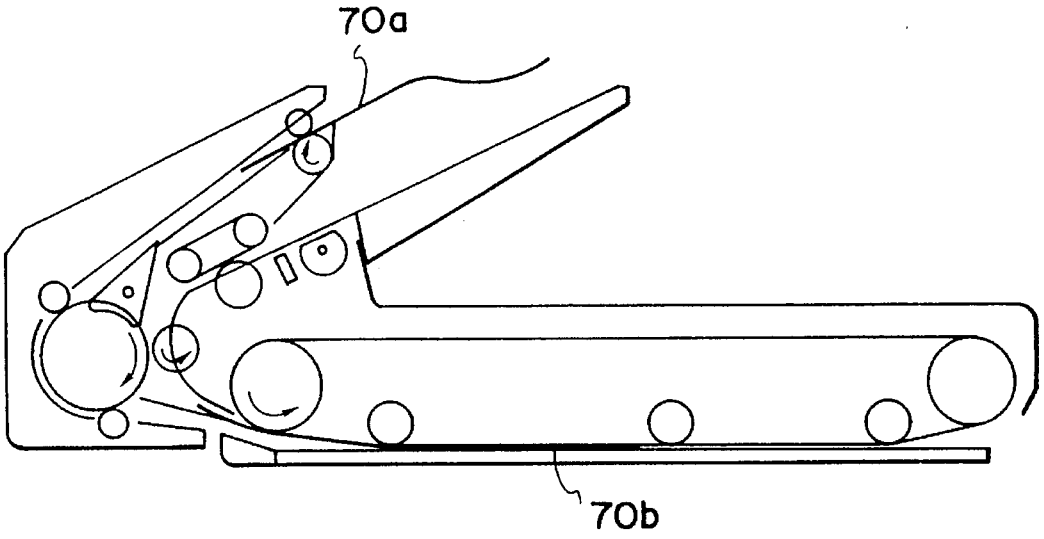

That is to say, when a sheet discharge signal is sent from the copying machine 2, the sheet discharge is started (step S231). The belt motor 66 is rotated reversely to convey the first original 70*a* from the platen glass 3 to the sheet discharge path. In this case, before the leading end (in the advancing direction) of the original 70*a* enters into the nip between drive roller 19 and the first drive roller 20, the drive motor 63 is turned ON (step S233) to start the sheet supply of the second original 70*b*, thereby establishing a condition shown in FIG. 14. Before the leading end (in the advancing direction) of the second original 70*b* reaches the convey belt 7, the belt motor 66 is rotated in the normal direction (step S234). Thereafter, the first original 70*a* is discharged and the second original 70*b* is supplied, thereby causing the passing of the originals. The first original 70*a* is pinched between the drive roller 19 and the first and second drive rollers 20, 21 and is conveyed thereby. Then, the first original 70*a* is pinched between the discharge roller 22 and the auxiliary discharge roller 23 and is discharged thereby.

After the first original 70*a* is conveyed until its trailing end passes through the nip between the discharge roller 22 and the auxiliary discharge roller 23, the drive motor 63 is stopped (step S239). In this way, the discharge of the first original 70*a* and the supply of the second original 70*b* are finished.

By repeating the above-mentioned processes, the setting and copying of the originals are effected.

Next, the sheet thickness detection means and the sheet thickness treatment will be explained with reference to FIG. 7.

First of all, when the sheet thickness mode (step S204) described in connection with FIG. 5 is given, the sub-routine shown in FIG. 7 is effected. The signal from the sheet thickness sensor 75*a* or 75*b* is detected (step S262). If this signal is OFF, the sheet thickness flag is set to 0 (zero) (step S263).

On the other hand, if the signal from the sheet thickness sensor 75 is ON, i.e., if the sheet thickness is greater than the upper limit of the predetermined value range or if the sheet thickness is smaller than the upper limit of the predetermined value range, the sheet thickness flag is set to 1 (one) (step S264).

In this way, the sheet thickness detection mode is finished (step S265) and the main routine of FIG. 5 is restored. When the sheet thickness flag is set to 1, the numbers of rotations of the drive motor 63 and the belt motor 66 are made to 1/N ($N \geqq 1$) in comparison with the full-on condition. Where, N is an appropriate speed down constant which was obtained from the tests. In the actual apparatus, when the weight of the sheet is more than 104 g/m$^2$, N is set to 1.5 so that the speed is decreased to ⅔ in comparison with the normal sheet, thereby making the noise level to substantially the same as the normal sheet of 64 g/m$^2$.

In this case, the control is effected in accordance with the dot and chain lines shown in FIGS. 8 and 9. Incidentally, in this case, at the low speed condition, since the conveying distance becomes shorter within a given time period, it should be noted that ON time of the motor must be increased in accordance with the speed reduction ratio.

Next, a second embodiment of the present invention will be explained.

Figure 17:
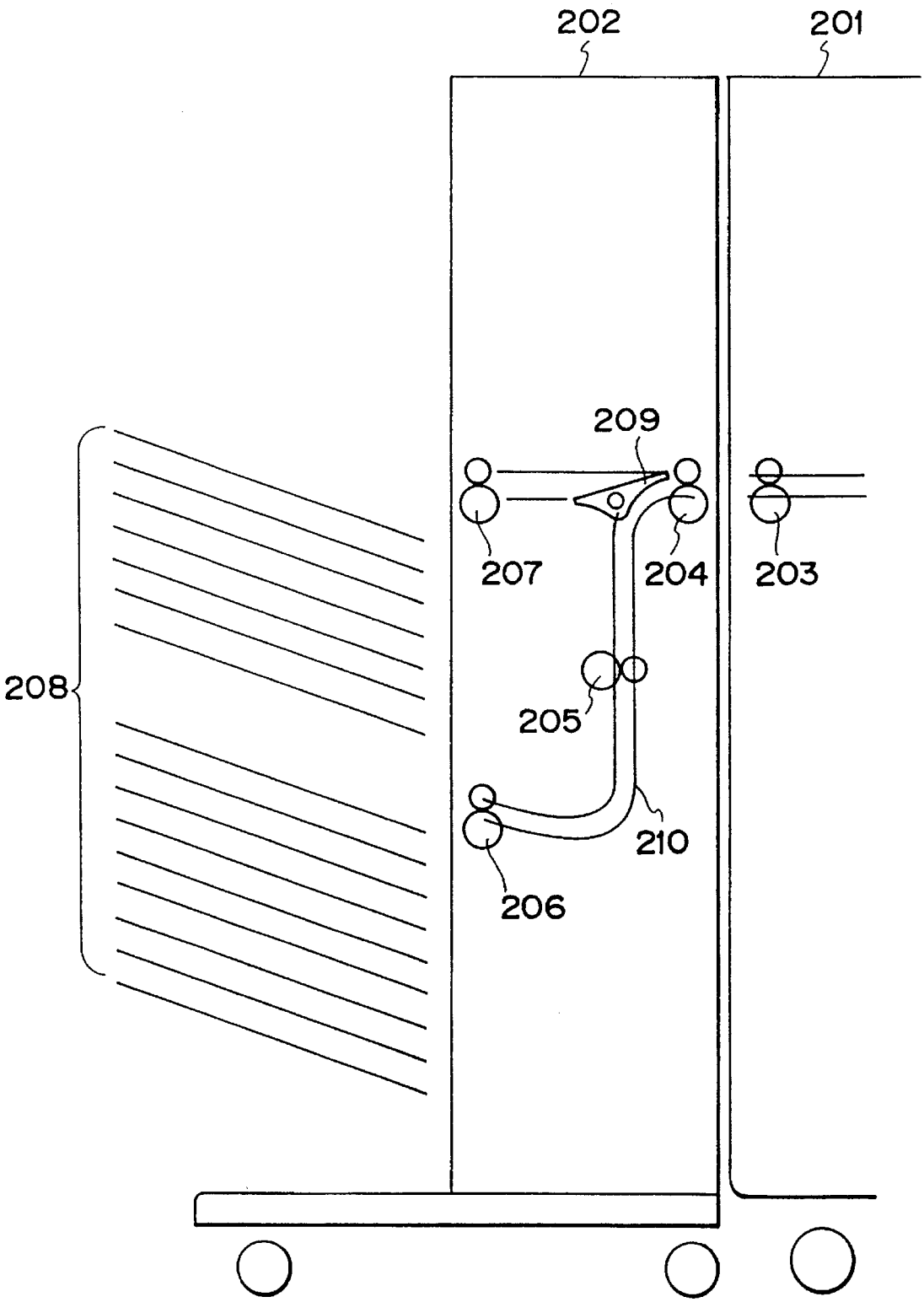
FIG. 17 is a longitudinal sectional view of a sorter to which the present invention is applied.
Figure 18:
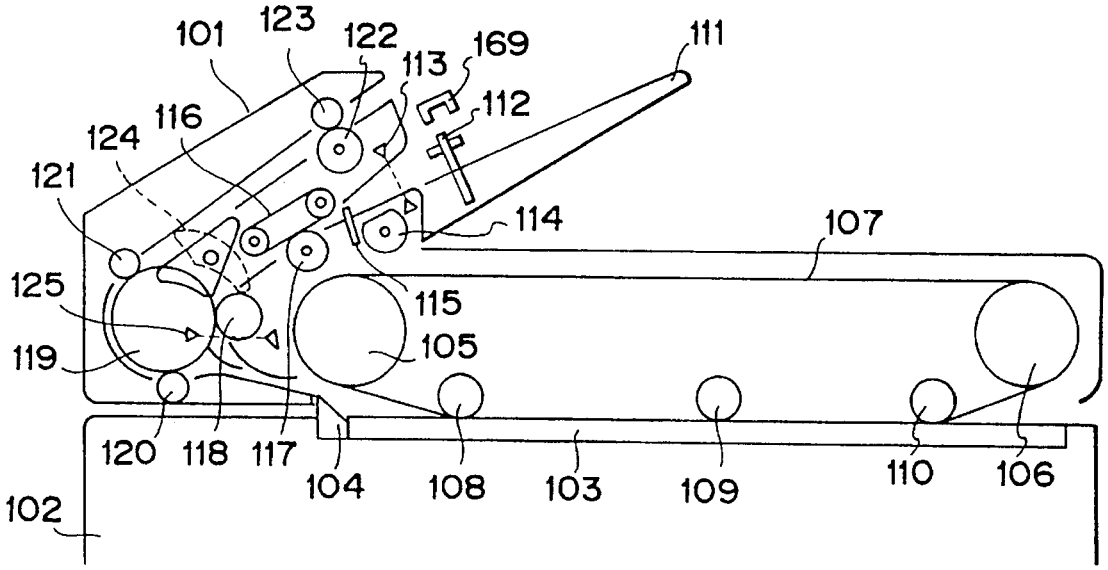
FIG. 18 PRIOR ART
FIG. 18 is a longitudinal sectional view of a conventional original feeding apparatus of circulating type.

An example that the present invention is applied to a sorter is shown in FIG. 17. A sorter 202 is connected to a sheet discharge opening of a body 201 of a copying machine. The sorter serves to gather the sheets copied by the copying machine 201 and discharged from the copying machine by a pair of sheet discharge rollers 203.

A first convey roller 204 serves to convey the sheet discharged from the copying machine. A peripheral speed of the first convey roller is slightly faster than those of the discharge rollers 203. A conveying path switching flapper 209 serves to direct the sheet to a straight path when the sheet is not sorted and to an S-shaped conveying path 210 when the sheet is sorted. A pair of non-sort rollers 207 serve to discharge the sheet above bins 208 when the sheet is not sorted. A pair of intermediate rollers 205 are disposed in the S-shaped conveying path 210, and a pair of sort rollers 206 are disposed at an outlet of the S-shaped conveying path 210. These rollers 205, 206 serve to pinch and convey the sheet when the sheet is sorted.

With this arrangement, in case of a thick sheet mode detected by a sheet thickness sensor of a sheet supply portion of the copying machine, when the sheet is conveyed through the S-shaped conveying path 210 of the sorter 202, the conveying speed of the sheet is reduced so that, when the sheet passes through a conveying path portion having a small radius of curvature, the noise generated by striking a trailing end of the sheet against a guide plate is reduced.

In the above embodiments, while an example that the conveying speed of the sheet is changed steppingly was explained, the present invention is not limited to this example, but the conveying speed of the sheet may be stagelessly decreased from a predetermined sheet thickness as the sheet thickness is increased or may be decreased from the predetermined sheet thickness as the sheet thickness is decreased.

Further, as the sheet thickness is increased or decreased, the conveying speed of the sheet may be varied steppingly.

As mentioned above, in the sheet convey apparatus having the convey means for pinching and conveying the sheet and the guide plate for regulating the zone through which the sheet passes, since the detection means for detecting the sheet thickness and the control means for controlling the conveying speed of the sheet are arranged at the upstream side so that the conveying speed is reduced when the sheet thickness is out of the predetermined range, it is possible to reduce the striking noise and/or the rubbing noise between the thick sheet and the guide plate, and, thus, to reduce the operating noise of the apparatus to a given level or less.

Further, it is possible to prevent the thin sheet from tearing when the sheet enters into the ribbed guide plate, thereby using the apparatus with a safe conscience.

Furthermore, the above-mentioned sheet convey apparatus may be applied to an image forming apparatus for forming an image on a sheet.

Such image forming apparatus has a convey means for conveying the sheet, and an image forming means for forming an image on the sheet conveyed by the convey means. The image forming apparatus may be of electrophotographic type or ink jet type. In such an image forming apparatus, as in the aforementioned embodiment, a detection means for detecting a thickness of the sheet conveyed by the convey means is provided, and a conveying speed of the convey means is controlled in accordance with the sheet thickness detected by the detection means. As in the aforementioned embodiment, when the sheet thickness is out of a predetermined range, the convey means is controlled so that the conveying speed of the convey means becomes slower than the conveying speed when the sheet thickness is within the predetermined range.

What is claimed is:

1. A sheet convey apparatus, comprising:

convey means for conveying a sheet;

guide means for guiding the sheet conveyed by said convey means along a convey path;

detection means for detecting a thickness of the sheet conveyed by said convey means; and control means for controlling said convey means so that said convey means conveys the sheet at a first speed when the thickness of the sheet detected by said detection means is a first thickness, and conveys the sheet at a second speed faster than the first speed when the thickness of the sheet is a second thickness larger than the first thickness, whereby deformation of the sheet caused by said guide means is avoided.

2. A sheet convey apparatus according to claim 1 wherein said control means decreases the conveying speed of said convey means as the thickness of the sheet becomes thinner than a predetermined value.

3. A sheet convey apparatus according to claim 1, wherein said control means controls said convey means so that the slower the conveying speed of said convey means, the thicker the thickness of the sheet detected by said detection means from a predetermined value.

4. A sheet convey apparatus according to claim 1, wherein said guide means guides the sheet along a curved passage.

5. A sheet convey apparatus according to claim 1, wherein said detection means has a pair of pinching members for pinching the sheet.

6. A sheet convey apparatus according to claim 5, wherein said detection means detects the thickness of the sheet by detecting that said pair of pinching members is in a predetermined range.

7. A sheet convey apparatus according to claim 6, wherein said pinching member has a rotary member contacting with said sheet while rolling on the sheet.

8. An image forming apparatus, comprising:

convey means for conveying a sheet;

guide means for guiding the sheet conveyed by said convey means along a passage;

detection means for detecting a thickness of the sheet conveyed by said convey means;

control means for controlling said convey means so that said convey means conveys the sheet at a first speed when the thickness of the sheet detected by said detection means is a first thickness, and conveys the sheet at a second speed faster than the first speed when the thickness of the sheet is a second thickness larger than the first thickness, whereby deformation of the sheet caused by said guide means is avoided; and image forming means for forming an image on the sheet conveyed by said convey means.

9. An image reading apparatus, comprising:

convey means for conveying a sheet;

guide means for guiding the sheet conveyed by said convey means along a passage;

detection means for detecting a thickness of the sheet conveyed by said convey means;

control means for controlling said convey means so that said convey means conveys the sheet at a first speed when the thickness of the sheet detected by said detection means is a first thickness, and conveys the sheet at a second speed faster than the first speed when the thickness of the sheet is a second thickness larger than the first thickness, whereby deformation of the sheet caused by said guide means is avoided; and image reading means for reading an image on the sheet conveyed by said convey means.

10. A sheet sorting apparatus, comprising:

convey means for conveying a sheet;

guide means for guiding the sheet conveyed by said convey means along a passage;

detection means for detecting a thickness of the sheet conveyed by said convey means;

control means for controlling said convey means so that said convey means conveys the sheet at a first speed when the thickness of the sheet detected by said detection means is a first thickness, and conveys the sheet at a second speed faster than the first speed when the thickness of the sheet is a second thickness larger than the first thickness, whereby deformation of the sheet caused by said guide means is avoided; and sorting means for sorting the sheets conveyed by said convey means into groups.

11. A method for conveying a sheet, comprising the steps of:

measuring a thickness of a sheet;

determining a conveying speed of the sheet so that the conveying speed of the sheet is a first speed when the thickness of the sheet is a first thickness, and the conveying speed of the sheet is a second speed faster than the first speed when the thickness of the sheet is a second thickness larger than the first thickness; and conveying the sheet at the determined conveying speed along a conveying path.

12. A sheet convey apparatus, comprising:

a convey rotary member for conveying a sheet;

guide means for guiding the sheet conveyed by said convey rotary member along a convey path;

a controller for controlling a conveying speed of said convey rotary member so that the conveying speed of the sheet is a first speed when the thickness of the sheet is a first thickness, and the conveying speed of the sheet is a second speed faster than the first speed when the thickness of the sheet is a second thickness larger than the first thickness, whereby deformation of the sheet caused by said guide means is avoided.

13. A sheet convey apparatus according to claim 12, wherein said controller decreases the conveying speed of said convey rotary member as the thickness of the sheet becomes thinner than a predetermined value.

14. A sheet convey apparatus according to claim 12, further comprising a sensor for detecting a thickness of the sheet conveyed by said convey rotary member, wherein said controller controls said convey rotary member so that the slower the conveying speed of said convey rotary member, the thicker the thickness of the sheet detected by said detection means from a predetermined value.

15. A sheet convey apparatus according to claim 12, wherein said guide means guides the sheet along a curved passage.

16. A sheet convey apparatus according to claim 12, further comprising a sensor for detecting a thickness of the sheet conveyed by said convey rotary member, wherein said detection means has a pair of pinching members for pinching the sheet.

17. A sheet convey apparatus according to claim 16, wherein said sensor detects the thickness of the sheet by detecting that a gap between said pair of pinching members is in a predetermined range.

18. A sheet convey apparatus according to claim 17, wherein said pinching member has a rotary member contacting with said sheet while rolling on the sheet.

19. A sheet convey apparatus, comprising:

a convey rotary member for conveying a sheet by rotating contact with the sheet;

a guide for guiding the sheet conveyed by said convey rotary member along a path;

a thickness information output portion for outputting information regarding a thickness of the sheet conveyed by said convey rotary member; and a control circuit for controlling said convey rotary member so that it rotates at a first rotation speed when the sheet has a first thickness, and rotates at a second rotation speed faster than the first rotation speed when the sheet has a second thickness larger than the first thickness, based on the information outputted at said thickness information output portion.

20. A sheet convey apparatus according to claim 19, wherein said control circuit controls said convey rotary member to rotate it in the second rotation speed when the information of sheet thickness outputted at said information output portion is larger than a predetermined value.

21. A sheet convey apparatus according to claim 19, wherein said control means control said convey rotary member to rotate it slower as the information of sheet thickness outputted at said information output portion becomes larger.

22. A sheet convey apparatus according to claim 19, wherein said guide guides the sheet along a curved path.

23. A sheet convey apparatus according to claim 19, further comprising an image formation portion for forming an image on the sheet conveyed by said convey rotary member.

24. A sheet convey apparatus, comprising:

a convey rotary member for conveying a sheet by rotating contact with the sheet;

a guide have a rib-like convex portion to be abutted against a least end of the sheet conveyed by said convey rotary member, for guiding it along a curved path by the rib-like convex portion;

a thickness information output portion for outputting information regarding thickness of the sheet conveyed by said convey rotary member; and a control circuit for controlling said convey rotary member so that it rotates at a first rotation speed when the sheet has a first thickness, and rotates at a second rotation speed slower than the first rotation speed when the sheet has a second thickness smaller than the first thickness based on the information outputted at said thickness information output portion.

25. A sheet convey apparatus according to claim 24, wherein said control circuit controls said convey rotary member to rotate it in the second rotation speed when the information of sheet thickness outputted at said information output portion is smaller than a predetermined value.

26. A sheet coney apparatus according to claim 24, wherein said control means controls said convey rotary member to rotate it slower as the information of sheet thickness outputted at said information output portion becomes smaller.

27. A sheet convey apparatus according to claim 24, further comprising an image formation portion for forming an image on the sheet conveyed by said convey rotary member.

28. A sheet convey apparatus, comprising:

convey means for conveying a sheet;

guide means for guiding the sheet conveyed by said convey means along a path;

thickness information emitting means for emitting thickness information about the sheet conveyed by said convey means; and control means for controlling said convey means in accordance with the thickness information emitted by said thickness information emitting means so that said convey means conveys the sheet at a first speed when the thickness of the sheet is a first thickness, and conveys the sheet at a second speed slower than the first speed when the thickness of the sheet is a second thickness smaller than the first thickness.

29. A sheet convey apparatus according to claim 28, wherein said control means controls said convey means so that said convey means conveys the sheet at the second speed when the thickness of the sheet is less than a predetermined thickness.

30. A sheet convey apparatus according to claim 28, wherein said control means controls said convey means so that, as the thickness of the sheet becomes less than a predetermined thickness, said convey means conveys the sheet at a slower speed.

31. A sheet convey apparatus according to claim 28, wherein said guide means guides the sheet along a curved path.

32. A sheet convey apparatus according to claim 28, further comprising an image forming portion for forming an image on the sheet conveyed by said convey means.

33. A sheet convey apparatus, comprising:

convey means for conveying a sheet;

guide means for guiding the sheet conveyed by said convey means along a curved convey path;

detection means for detecting a thickness of the sheet conveyed by said convey means; and control means for controlling said convey means so that said convey means conveys the sheet at a first speed when the thickness of the sheet detected by said detection means is a first thickness, and conveys the sheet at a second speed slower than the first speed when the thickness of the sheet is a second thickness smaller than the first thickness, whereby deformation of the sheet caused by said guide means is avoided.

34. A sheet convey apparatus according to claim 33, wherein said control means controls said convey means so that said convey means conveys the sheet at the second speed when the thickness of the sheet detected by said detection means is smaller than a predetermined thickness.

35. A sheet convey apparatus according to claim 33, further comprising an image forming portion for forming an image on the sheet conveyed by said convey means.

36. A sheet convey apparatus, comprising:

convey means for conveying a sheet;

a guide means for guiding the sheet conveyed by said convey means along a curved path;

thickness information emitting means for emitting thickness information about a thickness of the sheet conveyed by said convey means; and control means for controlling said convey means in accordance with the thickness information emitted by said thickness information emitting means so that said convey means conveys the sheet at a first speed when the thickness of the sheet is a first thickness, and conveys the sheet at a second speed slower than the first speed when the thickness of the sheet is a second thickness smaller than the first thickness.

37. A sheet convey apparatus according to claim 36, wherein said control means controls said convey means so that said convey means conveys the sheet at the second speed when the thickness of the sheet emitted from said thickness information emitting means is smaller than a predetermined value.

38. A sheet convey apparatus according to claim 36, further comprising an image forming portion for forming an image on the sheet conveyed by said convey means.

* * * * *

UNITED STATES PATENT AND TRADEMARK OFFICE

CERTIFICATE OF CORRECTION

PATENT NO. : 5,599,014

DATED : February 4, 1997

INVENTOR(S) : Yoshihiko KITAHARA, et al.

Figure 4:
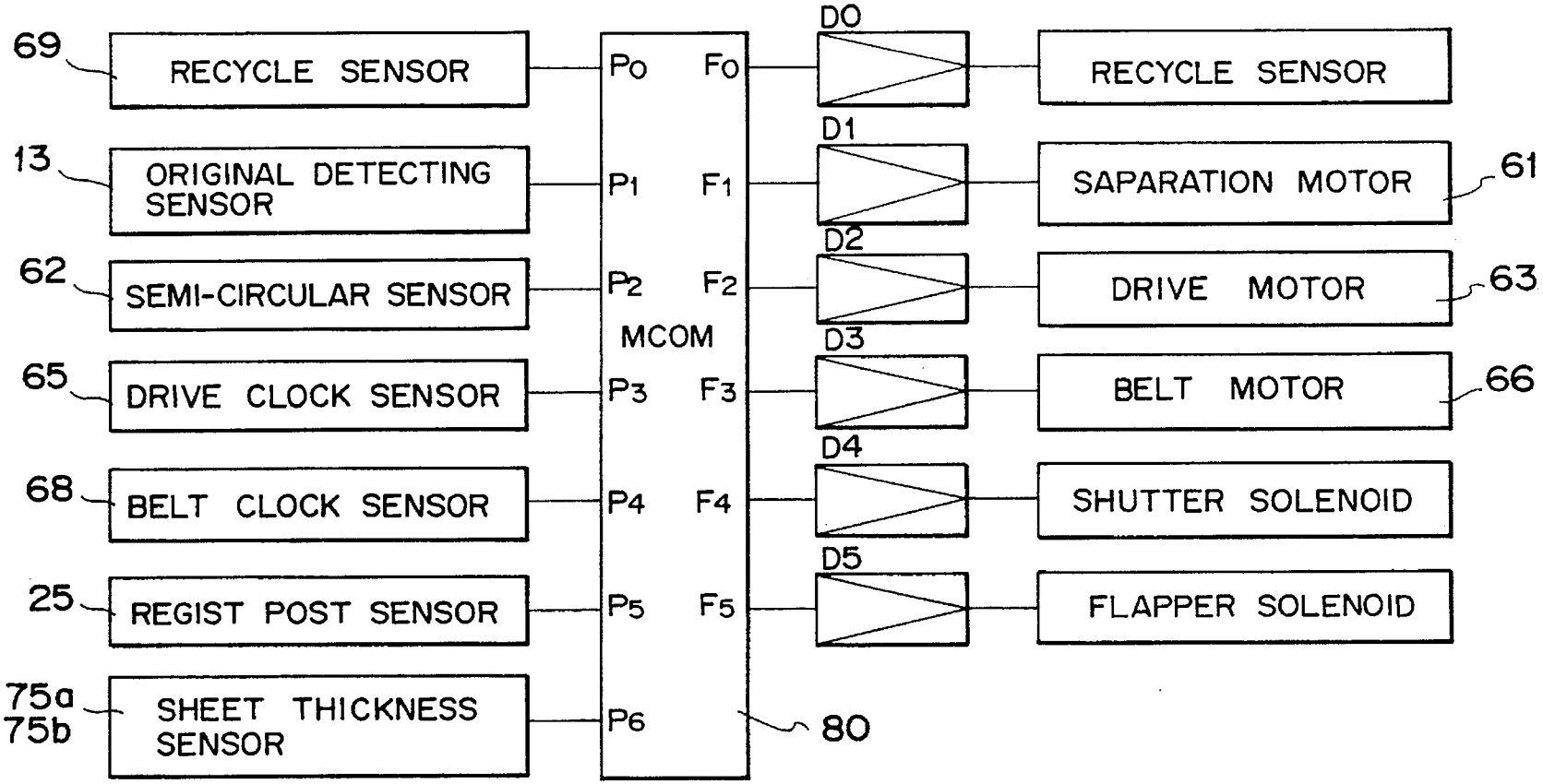
FIG. 4 is a control circuit diagram of the original feeding apparatus of circulating type of FIG. 1.

It is certified that error appears in the above-indentified patent and that said Letters Patent is hereby corrected as shown below:

In the Drawings:

FIGURE 4, Sheet 3 of 14:

Reference numeral "61", "SAPARATION" should read --SEPARATION--.

FIGURE 8, Sheet 7 of 14:

Reference numeral "61", "SAPARATION" should read --SEPARATION--.

FIGURE 9, Sheet 8 of 14:

Reference numeral "61", "SAPARATION" should read --SEPARATION--

COLUMN 2:

Line 11, "the great" should read --a loud--;

Line 15, "lever" should read --level--.

COLUMN 4:

Line 44, "an" should read --at--; and

"interval" should read --intervals--;

Line 54, "interval" should read --intervals--;

Line 57, "slit" should read --slits--.

COLUMN 5:

Line 46, "0N" should read --ON--.

COLUMN 7:

Line 12, delete "to";

Line 13, after "as", insert --with--;

Line 23, "that" should read --of--; and delete "to";

Line 31, "those" should read --that--;

Line 42, after "in", insert --the--;

Line 50, "that" should read --where--.

UNITED STATES PATENT AND TRADEMARK OFFICE

CERTIFICATE OF CORRECTION

PATENT NO. : 5,599,014
DATED : February 4, 1997
INVENTOR(S) : Yoshihiko KITAHARA, et al.

It is certified that error appears in the above-indentified patent and that said Letters Patent is hereby corrected as shown below:

COLUMN 10:

Line 43, "in" should read --at--;
Line 48, "slower" should read --more slowly--;
Line 60, "have" should read --having--.

COLUMN 11:

Line 10, "in" should read --at--;
Line 13, "coney" should read --convey--;
Line 15, "slower" should read --more slowly--.

COLUMN 12:

Line 13, "slower" should read --more slowly--.

Signed and Sealed this

Twenty-second Day of July, 1997

Bruce Lehman

*Attest:*

BRUCE LEHMAN

*Attesting Officer*

*Commissioner of Patents and Trademarks*